United States Patent [19]

Nguyen et al.

[11] Patent Number: 5,062,520

[45] Date of Patent: Nov. 5, 1991

[54] SELF ADJUSTABLE HANDRAIL DRIVE WITH SEPARATE DRIVE CHAINS

[75] Inventors: Dat Nguyen, New Britain; Frank Sansevero, West Hartford; Gerald E. Johnson, Farmington; James A. Rivera, Bristol, all of Conn.

[73] Assignee: Otis Elevator Company, Farmington, Conn.

[21] Appl. No.: 550,926

[22] Filed: Jul. 11, 1990

[51] Int. Cl.[5] ..... B66B 23/02

[52] U.S. Cl. ..... 198/335

[58] Field of Search ..... 198/330, 331, 335, 835

[56] References Cited

U.S. PATENT DOCUMENTS

| | | | |
|---|---|---|---|
| 3,653,484 | 4/1972 | Taylor | 198/335 |
| 3,666,075 | 5/1972 | Iwata | 198/335 |
| 3,749,224 | 7/1973 | Engeler | 198/336 X |
| 4,200,177 | 4/1980 | Sato et al. | 198/335 |
| 4,589,539 | 5/1986 | Boltrek et al. | 198/331 |
| 4,674,619 | 6/1987 | Nakazawa et al. | 198/336 X |
| 4,875,568 | 10/1989 | Herman et al. | 198/335 |
| 4,901,839 | 2/1990 | Johnson | 198/335 |

FOREIGN PATENT DOCUMENTS

| | | | |
|---|---|---|---|
| 0031479 | 3/1977 | Japan | 198/335 |
| 0022686 | 2/1979 | Japan | 198/335 |
| 0779236 | 11/1980 | U.S.S.R. | 198/336 |
| 2047646 | 12/1980 | United Kingdom | 198/331 |

*Primary Examiner*—D. Glynn Dayoan

*Attorney, Agent, or Firm*—William J. Jones

[57] ABSTRACT

The handrail drive has opposed rollers which are movable toward and away from each other due to their eccentric mountings. Two sets of such opposed rollers are used to drive the handrail. Each set of rollers is equipped with its own drive chain to increase the efficiency of each set of drive rollers with ultra high loads. The drive is particularly suited for moving high load escalator and moving walkway handrails.

7 Claims, 2 Drawing Sheets

SELF ADJUSTABLE HANDRAIL DRIVE WITH SEPARATE DRIVE CHAINS

TECHNICAL FIELD

This invention relates to a handrail drive suitable for use in an escalator or moving walkway, which handrail drive applies increasing pressure to the handrail as resistance to movement of the handrail increases.

BACKGROUND ART

U.S. Pat. No. 4,901,839 granted Feb. 20, 1990 to G. E. Johnson, et al. discloses a self adjustable escalator handrail drive which utilizes drive rollers which are eccentrically mounted in rotatable bearings. The drive may include two pairs of drive rollers which are driven by a chain and sprocket assembly. The sprockets are mounted on each drive roller shaft, and the drive chain is entrained around each of the sprockets and around a drive sprocket connected to an electric motor. The drive roller pairs serially engage the handrail in a mangle-like arrangement. This arrangement can successfully drive a considerable load, but does display certain inefficiencies due to the use of the single chain to drive four roller sprockets. The drive roller set closest to the drive sprocket runs at a higher efficiency then the drive roller set further from the drive sprocket. It would be desirable to be able to increase the drive power of this type of self-tightening handrail drive to be able to drive handrails on longer moving walkways, and to drive handrails on curved escalators, which involve higher friction loads due to the curvature in plan of the path of travel of the handrail.

DISCLOSURE OF THE INVENTION

This invention relates to a self-tightening multiple nip mangle-type handrail drive which produces greater driving power, and can drive a handrail offering more than 150% of resistance over the maximum resistance derivable by the aforesaid prior art device. The increase in available power and efficiency is the result of using separate drive chains for driving each drive roller pair. The two drive chains are both entrained on a common dual drive sprocket which is rotated by an electric motor.

It is therefore an object of this invention to provide a self-tightening mangle type handrail drive with improved driving ability.

It is a further object of this invention to provide a handrail drive of the character described having two pairs of drive rollers with each pair being driven by a separate drive chain.

It is another object of this invention to provide a handrail drive of the character described wherein each drive chain is entrained on a common drive sprocket.

These and other objects and advantages of the invention will become more readily apparent from the following detailed description of a preferred embodiment thereof when taken in conjunction with the accompanying drawings, in which:

BEST MODE FOR CARRYING OUT THE INVENTION

Figure 4:
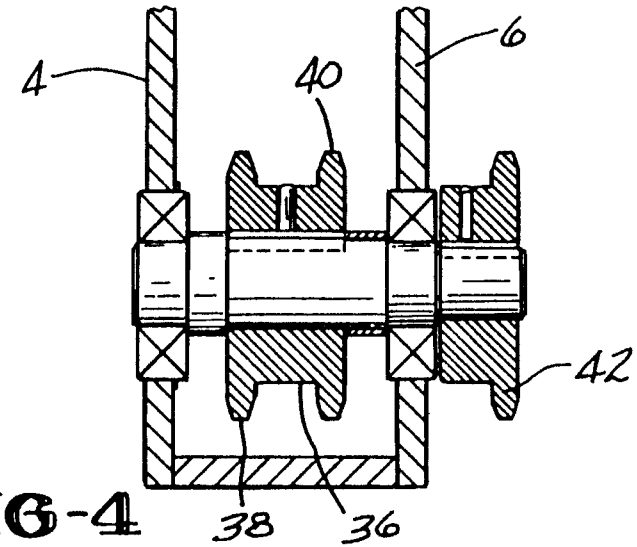
FIG. 4 is a sectional view taken along line 4—4 of FIG. 1.

Referring now to the drawings, the handrail drive assembly, denoted generally by the numeral 2, includes a housing having a front wall 4 and a back wall 6 secured to a base 8. A first set of drive rollers 10, 12 and a second set of drive rollers 14, 16 are mounted on rotating shafts 18, 20 and 22, 24 respectively. The shafts 18, 20 and 22, 24 extend through the front and back walls 4 and 6, and carry toothed sprockets 26, 28 and 30, 32 respectively. A drive shaft 34 is journaled in the front and back walls 4 and 6. The shaft 34 carries a duplex sprocket 36 with two sets of teeth 38 and 40 between the walls (see FIG. 4), and an external drive sprocket 42 to which driving power is transmitted by a chain (not shown) driven by an electric motor (not shown). A pair of idler sprockets 44 and 46 are mounted on shafts 48, 50 journaled on plates 52, 54 respectively. Angle brackets 56 and 58 are bolted to front and back walls 4 and 6 respectively. Rods 60 and 62 pass through flanges 64 and 66. Springs 68 and 70 are mounted on the rods 60 and 62 and engage the flanges 56 and 58 at one end, and stop washers 72 and 74 mounted on the rods 60 and 62. The springs 68 and 70 thus bias the idler sprockets 44 and 46 away from the drive sprockets 38 and 40.

Figure 1:
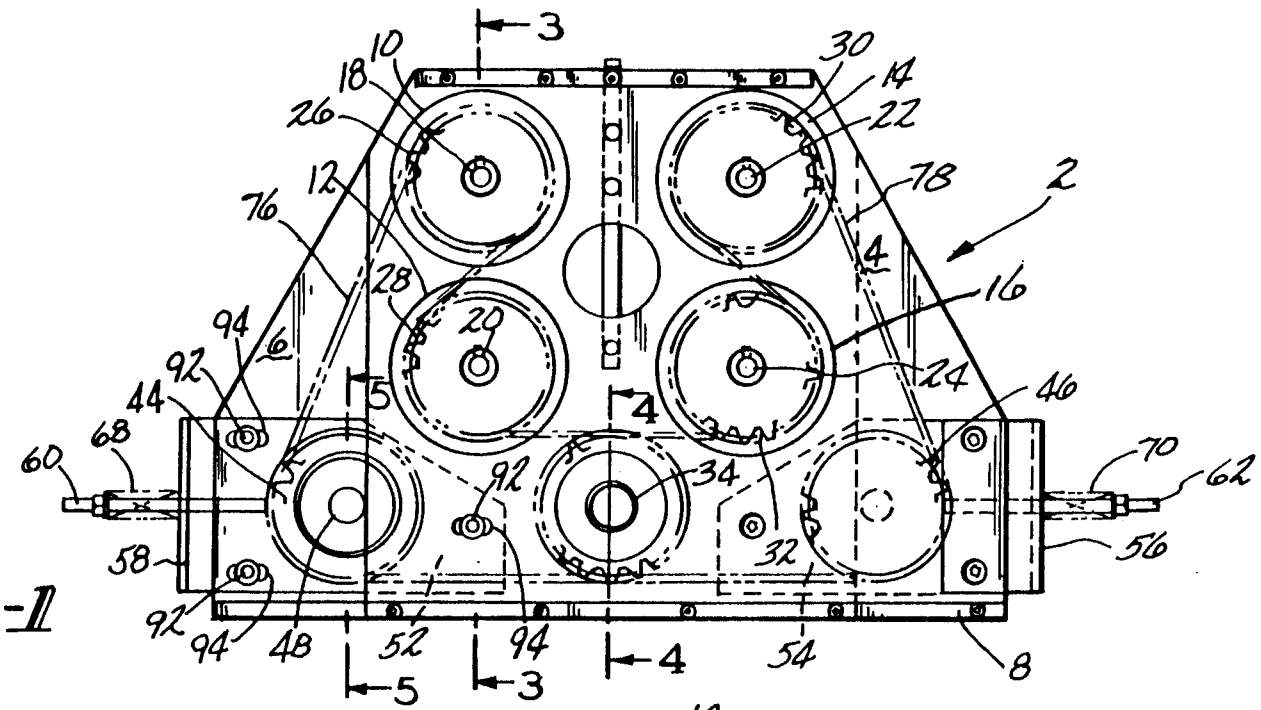
FIG. 1 is a front elevational view of a handrail drive assembly of this invention.
Figure 2:
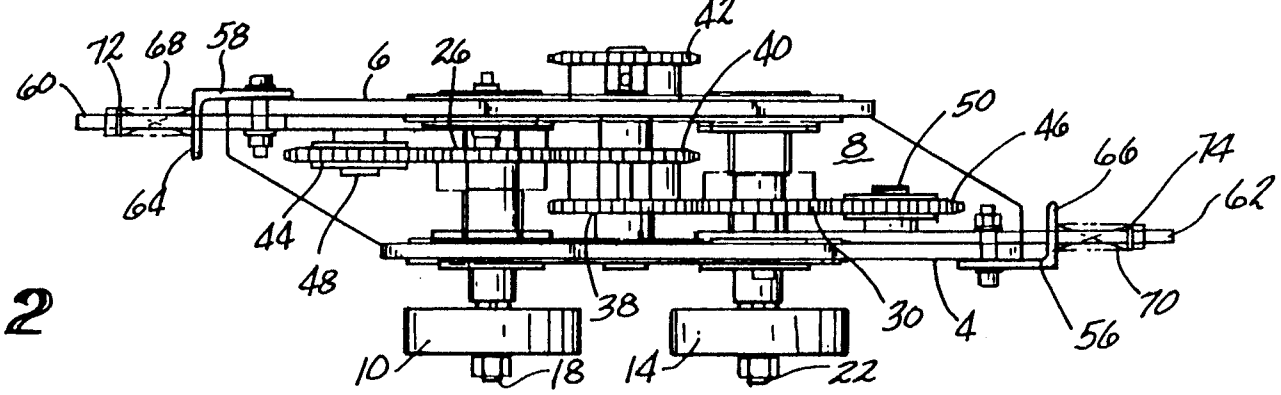
FIG. 2 is a top plan view of the assembly of FIG. 1.

There is one drive chain 76 entrained on the sprockets 26, 28, 40 and 44; and another drive chain 78 entrained on the sprockets 30, 32, 38 and 46. Looking at FIG. 2, it will be noted that the sprockets 30, 32, 38 and 46 are disposed closer to the wall 4, while the sprockets 26, 28, 40 and 44 are disposed closer to the wall 6.

Figure 3:
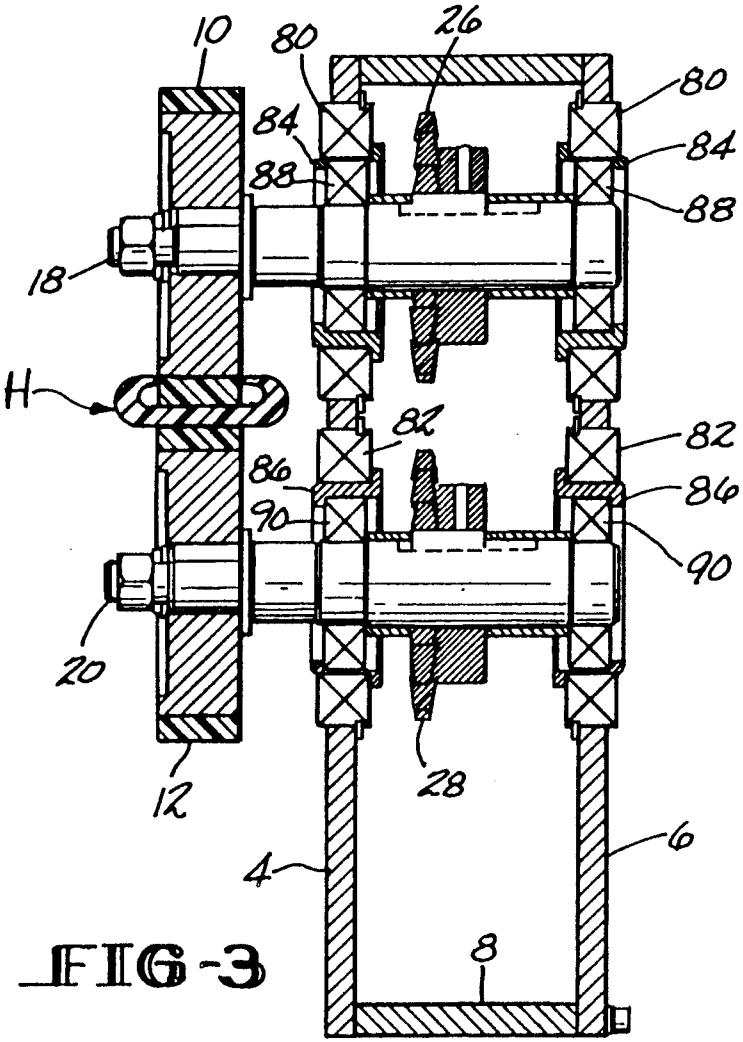
FIG. 3 is a sectional view taken along line 3—3 of FIG. 1.

Referring to FIG. 3, the manner in which the rollers 10 and 12, and their roller shafts 18 and 20 are mounted in the housing walls 4 and 6 is shown. Outer bearings 80 and 82 are mounted in the housing walls 4 and 6. Eccentric rings, or bushings 84 and 86 are mounted in the bearings 80 and 82 respectively. Because of the bearings 80 and 82, the bushings 84 and 86 can rotate within the walls 4 and 6. Inner bearings 88 and 90 are mounted in the bushings 84 and 86, and the roller shafts 18 and 20 are mounted in the inner bearings 88 and 90 respectively. Due to the eccentric bushings 84 and 86, the roller shafts 18', 20 and rollers 10, 12 rotate about an axis which is offset from the axis of the bearings 80 and 82. Thus the rollers 10 and 12 rotate in the eccentric bushings 84 and 86, and the bushings 84 and 86 can also rotate in the walls 4 and 6. The drag force exerted by the chains on the sprockets is what causes the bushings 84 and 86 to pivot toward each other in the walls 4 and 6. If friction acting on the handrail H increases, then the chains 76 and 78 will pull harder on the sprockets, which in turn will result in further pivoting of the bushings 86 and 88 which causes a further tightening of the rollers 10, 12, 14 and 16 on the handrail H.

Figure 5:
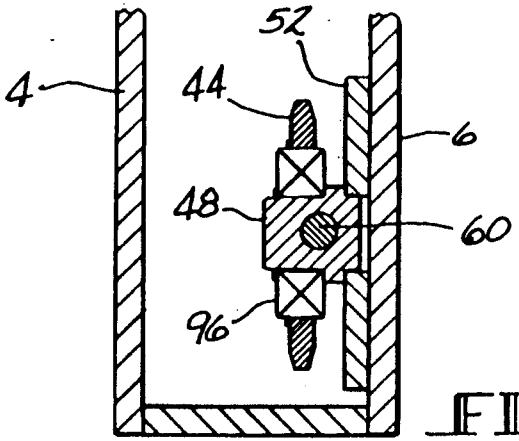
FIG. 5 is a sectional view of taken along line 5—5 of FIG. 1.

The biased idler sprockets 44 and 46 operate as follows. Referring to FIG. 5, the plates 52, 54 which carry the stub shafts 48 are mounted on the walls 4 and 6 by means of bolts 92 disposed in elongated slots 94 in the plates 52, 54. Thus, the plates 52, 54 can slide back and forth with respect to the housing walls 4 and 6. The bolts 92 also hold the angle brackets 56, 58 in place on the housing walls 4 and 6. The rods 60, 62 are fixed to the stub shafts 48, which in turn are set in the plates 52, 54, thus the rods 60, 62, plates 52, 54 and stub shafts 48 all can move as a unit on the housing. The springs 68 and 70 thus bias the sprockets 44, 46 in opposite directions away from the drive sprocket 36. It will be noted that each of the idler sprockets 44, 46 is mounted on the stub shafts 48 by means of a bearing 96 whereby the sprockets 44, 46 can freely rotate on the fixed stub shafts 48.

It will be readily understood that the drive assembly of this invention is able to overcome greater resistance to handrail movement than the prior art handrail drive. The use of two separate drive chains increases the efficiency of each roller set by reducing the number of sprockets interposed between the drive sprocket and the roller sprockets. The use of the tensioning sprockets eliminates chain slackening, and allows smooth reversal of direction of the driver.

Since many changes and variations of the disclosed embodiment of the invention may be made without departing from the inventive concept, it is not intended to limit the invention otherwise than as required by the appended claims.

What is claimed is:

1. A handrail drive assembly for a moving handrail, said assembly comprising:

a) a first pair of drive rollers mounted on first rotatable drive roller shafts, said first drive rollers forming a first nip through which the handrail passes;

b) first rotatable end bearings supporting opposite ends of said first drive roller shafts, said first end bearings being mounted eccentrically of said first drive roller shafts;

c) a second pair of drive rollers mounted on second rotatable drive roller shafts, said second drive rollers forming a second nip adjacent said first nip, and through which the handrail passes;

d) second rotatable end bearings supporting opposite ends of said second drive roller shafts, said second end bearings being mounted eccentrically of said second drive roller shafts; and e) first and second separate drive chains for separately rotating and first and second drive rollers and drive roller shafts respectively in said first and second end bearings whereby the axes of said drive rollers in each of said first and second pairs thereof move toward each other due to the eccentricity of said shafts and bearings to increase nip pressure on the handrail responsive to resistance to movement of the handrail.

2. The handrail drive assembly of claim 1 wherein said first and second chains are mounted on first and second sprockets on said first and second drive roller shafts respectively.

3. The handrail drive assembly of claim 2 wherein said first and second chains are mounted on first and second drive sprockets respectively.

4. The handrail drive assembly of claim 3 wherein said first and second drive sprockets are mounted on a common powered drive shaft.

5. The handrail drive assembly of claim 2 further comprising tensioning means operably acting on said first and second chains to minimize slack therein.

6. The handrail drive assembly of claim 5 wherein said tensioning means comprises first and second tension sprockets engaging said first and second chains, and spring means operable to bias said first and second tension sprockets in respective chain slack uptake directions.

7. The handrail drive assembly of claim 6 wherein said tension sprockets are mounted on stub shafts journaled to separate movable mounts, and said spring means is operable to bias said mounts in said chain slack uptake directions.

* * * * *

UNITED STATES PATENT AND TRADEMARK OFFICE

CERTIFICATE OF CORRECTION

PATENT NO. : 5,062,520

DATED : November 5, 1991

INVENTOR(S) : Dat Nguyen, et al

It is certified that error appears in the above-identified patent and that said Letters Patent is hereby corrected as shown below:

In column 2, line 48, please delete "18',20" and insert --18,20-- in lieu thereof.

In column 4, line 6, please delete "and" (1st occurrence) and insert --said-- in lieu thereof.

Signed and Sealed this

Sixth Day of April, 1993

*Attest:*

STEPHEN G. KUNIN

*Attesting Officer*

*Acting Commissioner of Patents and Trademarks*